US011364986B2

(12) United States Patent
Vopal

(10) Patent No.: US 11,364,986 B2
(45) Date of Patent: Jun. 21, 2022

(54) ASYMMETRIC KAYAK PADDLE BLADE

(71) Applicant: Carl R. Vopal, Mequon, WI (US)

(72) Inventor: Carl R. Vopal, Mequon, WI (US)

( * ) Notice: Subject to any disclaimer, the term of this patent is extended or adjusted under 35 U.S.C. 154(b) by 0 days.

(21) Appl. No.: 16/903,550

(22) Filed: Jun. 17, 2020

(65) Prior Publication Data

US 2021/0394880 A1 Dec. 23, 2021

(51) Int. Cl.
*B63H 16/04* (2006.01)

(52) U.S. Cl.
CPC ..... *B63H 16/04* (2013.01)

(58) Field of Classification Search
CPC ..... B63H 16/00; B63H 16/04
USPC ..... 440/101
See application file for complete search history.

(56) References Cited

U.S. PATENT DOCUMENTS

| | | | | |
|---|---|---|---|---|
| 3,091,781 | A * | 6/1963 | Wisbrod | B63H 16/04 416/70 R |
| 4,264,275 | A | 4/1981 | Roderick, Sr. et al. | |
| 4,737,126 | A | 4/1988 | Lindeberg et al. | |
| D448,337 | S | 9/2001 | Dale | |
| 8,801,483 | B2 * | 8/2014 | Kicker | B63H 16/04 440/101 |
| 9,132,898 | B2 | 9/2015 | Mier Maza | |
| 10,308,337 | B1 | 6/2019 | Liveoak | |
| 2008/0057802 | A1 | 3/2008 | Wilkinson | |
| 2015/0118924 | A1 | 4/2015 | Hess | |

FOREIGN PATENT DOCUMENTS

| | | | |
|---|---|---|---|
| DE | 2014009801 | U1 | 12/2014 |
| DE | 2014009802 | U1 | 12/2014 |

* cited by examiner

*Primary Examiner* — Lars A Olson
(74) *Attorney, Agent, or Firm* — Andrus Intellectual Property Law, LLP

(57) ABSTRACT

A blade for a kayak paddle with a shaft can include a body extending from the shaft to a blade tip. The body has a cross-sectional profile separated at a chord line into a top section with an upper surface and a bottom section with a lower surface. The paddle can also include a shoulder section smoothly transitioning between the shaft and the blade body. The top section of the cross-sectional profile can be thicker than the bottom section and the upper surface exhibits more curvature than the lower surface, thereby increasing fluid flow speed over the upper surface to generate a lift force when the body is moved through water.

15 Claims, 3 Drawing Sheets

ASYMMETRIC KAYAK PADDLE BLADE

BACKGROUND

The disclosed system generally relates to paddles for kayaking, and in particular, Greenland style and traditional straight kayak paddles.

Kayak paddles have long been known and widely used. Kayak paddles of various types go back to use by natives of areas such as Greenland, the Aleutian islands, North America, and Europe as a means of human propulsion for a single person, or multiple persons sitting in tandem, in a narrow watercraft commonly known as a kayak.

A kayak paddle commonly has two blades and a shaft between the blades. Kayak paddles are generally made of materials that are light and buoyant. By holding the shaft, each blade is intermittently placed in the water and then pulled through the water as a means of propulsion forward. The kayak paddle can also be pushed through the water intermittently as a means of propulsion in reverse. A kayak paddle can be used to turn a kayak by placing one end of a kayak paddle in the water and pulling or pushing multiple times on only one side of the kayak. An experienced kayaker, however, can turn using leaning, edging, bracing techniques and/or by using bow and stern rudders.

A kayak paddle can also be used to maintain the stability of, or return a paddler and kayak to, an upright position by sweeping the kayak paddle across, or just below the surface of, the water. It should be noted that factors such as technique, body position, extension of the outstretched paddle blade, speed of the sweeping the paddle blade, and angle of the paddle when swept can determine the success for righting the paddler and kayak.

The narrow, thin, tapered style of traditional kayak paddles of Greenland, the Aleutian Islands, and North America have ends that are wider than their shaft and can provide minimal air and/or wind resistance while the paddle is raised. The narrow blades and flexibility of Greenland kayak paddles can reduce stress on the user's body. Traditional straight kayak paddles have wider blades than Greenland style paddles, but may be similar in overall length.

SUMMARY

The present disclosure relates to a kayak paddle with an asymmetrical paddle blade with a top side driving face configured to generate lift as the blade is moved through the water, which can enhance kayak paddle strokes.

A blade can be configured for a kayak paddle with a shaft. The blade can include a body extending from the shaft to a blade tip and a shoulder section smoothly transitioning between the shaft and the blade body. The body can have a cross-sectional profile separated at a chord line into a top section with an upper surface and a bottom section with a lower surface. The top section can be thicker than the bottom section and the upper surface can exhibit more curvature than the lower surface. This may increase the speed of water moving past the upper surface to generate a lift force when the body is moved through water.

In some embodiments, the lift force can act in a direction perpendicular to the chord line. A width of the blade body increases along an axial length of the blade between the shoulder section and the blade tip. Additionally or alternatively, a ratio of the upper section thickness to the lower section thickness can increase along an axial length of the blade between the shoulder section and the blade tip. In such an embodiment, the length of the upper surface can increase along the axial length of the blade.

In some embodiments, the lower surface can flatten between the shoulder section and the blade tip. The lower surface can include a planar face positioned between curved edges at opposite lateral sides of the cross-sectional profile. The lower surface can slope downward along the axial length of the blade. In such an embodiment, the lower surface can transition from a downward slope to an upward slope proximate the blade tip. Additionally or alternatively, the upper surface can slope downward along the axial length of the blade at a shallower angle than the slope of the lower surface.

A kayak paddle can include a shaft extending between opposite axial ends and two blades, one being attached to each of the axial ends of the shaft. Each blade can include a cross-sectional profile separated at a chord line into a top section with an upper surface and a bottom section with a lower surface. The top section can be thicker than the bottom section and the upper surface can exhibit more curvature than the lower surface. This may increase the speed of water moving past the upper surface to generate a lift force when the blade is moved through water.

In some embodiments, the kayak paddle can further include a shoulder section that provides a smooth transition between the shaft and the blade. The shaft can include a joint positioned between the opposite axial ends. In such an embodiment, the joint can include two corresponding joint sections that can be configured to be selectively disengaged from each other to separate the kayak paddle into a first half and a second half.

In some embodiments, a ratio of the upper section thickness to the lower section thickness may increase along an axial length of the blade. A width of the blade may increase along an axial length of the blade between the shoulder section and the blade tip. Additionally or alternatively, the lower surface may flatten between the shoulder section and the blade tip.

Various other features, objects and advantages of the invention will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

Unless otherwise specified or limited, the phrases "at least one of A, B, and C," "one or more of A, B, and C," and the like, are meant to indicate A, or B, or C, or any combination of A, B, and/or C, including combinations with multiple instances of A, B, and/or C. Likewise, unless otherwise specified or limited, the terms "mounted," "connected," "supported," and "coupled" and variations thereof are used broadly and encompass both direct and indirect mountings, connections, supports, and couplings. Further, unless otherwise specified or limited, "connected" and "coupled" are not restricted to physical or mechanical connections or couplings.

As used herein, unless otherwise limited or defined, discussion of particular directions is provided by example only, with regard to particular embodiments or relevant illustrations. For example, discussion of "top," "front," or "back" features is generally intended as a description only of the orientation of such features relative to a reference frame of a particular example or illustration. Correspondingly, for example, a "top" feature may sometimes be disposed below a "bottom" feature (and so on), in some arrangements or embodiments.

Embodiments of the disclosure may be further understood in reference to the figures.

Figure 1:
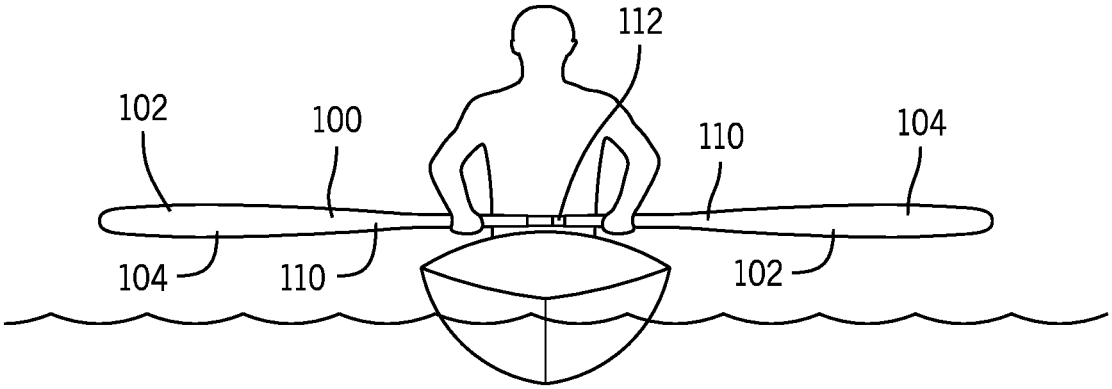
FIG. 1 is a front view of a user in a kayak with an embodiment of a paddle with an asymmetric blade.

FIG. 1 illustrate an embodiment of a kayak paddle 100 with a two blades 104 positioned on opposite axial ends of a shaft 108 configured to be held by a user. Each of the blades 104 can be connected to the shaft 108 by a shoulder section 110, which transitions from the generally circular cross-section of the shaft 108 to the asymmetrical cross-sectional profile of the blades 104. The shape of the cross-sectional profile of the blades 104 can be configured to generate lift as the blade 104 moves through the water. This may be useful, for example, in order to add stability and enhancing basic and advanced kayaking strokes including, for example, leaning, bracing, edging and sculling. While the illustrated embodiments relate to a kayak paddle with two blades attached to opposite ends of a shaft, some embodiments of a paddle can include a single blade secured to one end of a shaft.

Figure 2:
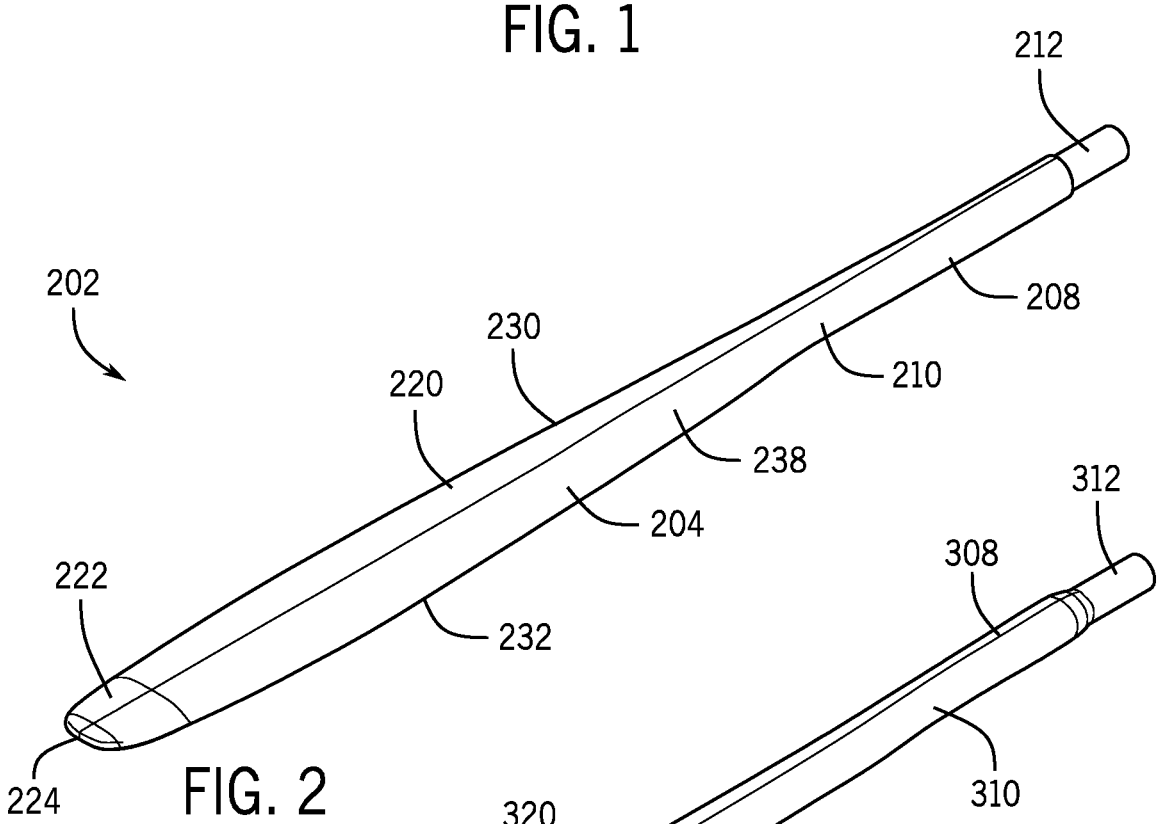
FIG. 2 is a perspective view of an embodiment of an asymmetric paddle blade.
Figure 3:
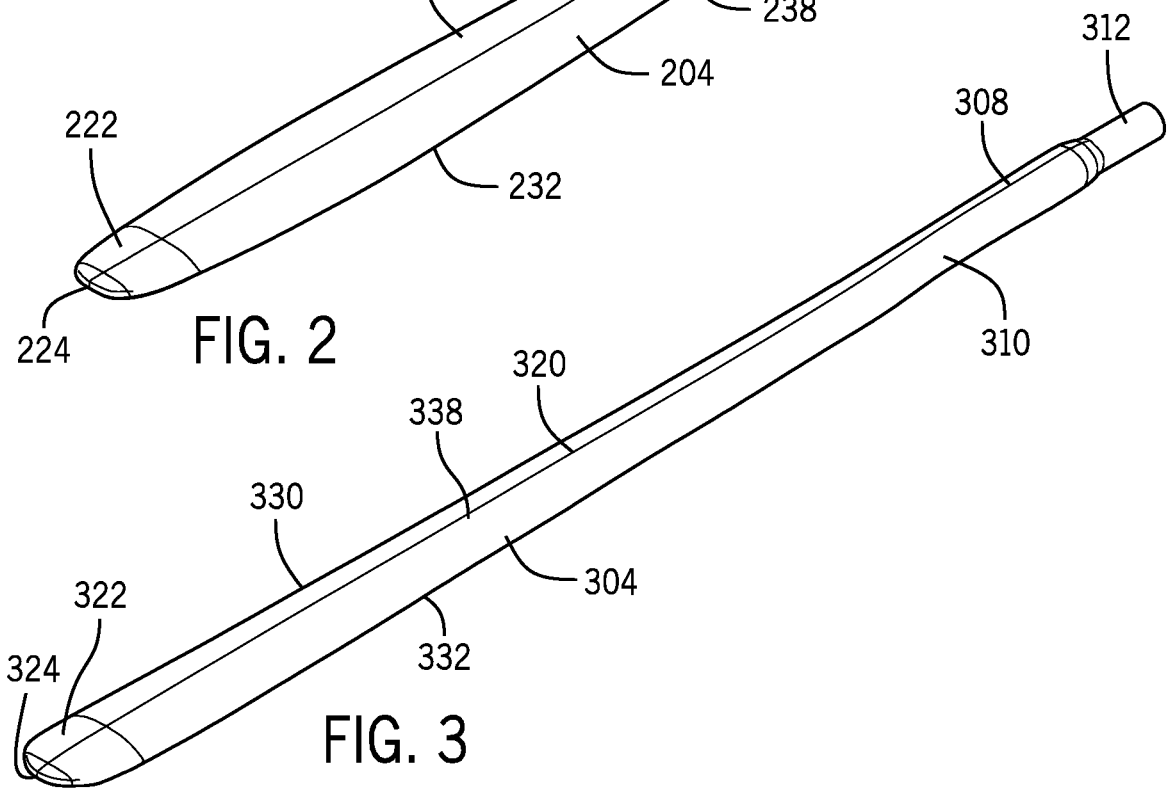
FIG. 3 is a perspective view of another embodiment of an asymmetric paddle blade.

In some embodiments, a paddle 100 can include two separable sections 102 that can be selectively coupled to each other by a joint 112. This may be useful to allow for easer transportation and storage of the paddle. FIGS. 2 and 3 illustrate embodiments of a paddle section 202, 302 that can be connected to a corresponding second paddle section at a joint 212, 312 positioned on the shaft 208, 308. Each joint 212, 312 is configured to selectively engage the corresponding joint on the second paddle section to inhibit axial and rotational movement between the two paddle sections. In some embodiments, the joints 212, 312 can be configured to allow a user to secure two paddle section 202, 302 to each other at various different angles. This may be useful, for example, to allow a user to adjust the feathering (i.e., the relative angle between the blades) of the kayak paddle. Typical feathering angles can include 45 degrees and 90 degrees of rotation between paddle blades. Some embodiments of a kayak paddle may include a joint configured as a ferule connector. Another embodiment can be configured as a unitary paddle that does not include a joint and cannot be separated into multiple parts.

Referring now to FIGS. 2 and 4-6F, a blade 204 can include a blade body 220 that extends from the shoulder 210 to a tip section 222 at the distal end 224 of the paddle section 202. Along the length of the blade 204, the cross-sectional profile of the blade 204 is divided into two sections by a chord line 228, which extends between the leading edge 230 and the trailing edge 232 of the cross-sectional profile. The illustrated blades 204 are configured with a straight chord line 228. However, some embodiments can include a cross-sectional profile that has a curved chord line. Above the chord line 228 is a top section 236, which includes the upper surface 238 of the blade 204, and a bottom section 240, which includes the lower surface 242 of the blade 204, is below the chord line 228. The upper and lower surfaces 238, 242 can provide a smooth, continuous curve that extends between lateral edges of the blade 204. A peak of the upper surface 238 and the lower surface 242 can be located proximate a midpoint between the lateral edges at an uppermost point 246 or a lowest point 248, respectively. As can be seen in FIGS. 6A-C, the thickness of the top section 236 (measured from the chord line 228 to the uppermost point 246 on the upper surface 238) is larger than the thickness of the lower section (measured from the chord line 228 to the lowest point 248 on the lower surface 242). The upper surface 238 can be longer and exhibit more curvature than the relatively flat lower surface 242. Thus, the top section 236 is relatively round compared to the bottom section 240.

Asymmetry between the thicknesses of the top and bottom sections and the curvature of the upper and lower surfaces can result in a fluid flow pattern around the blade 204 that results in a lift force in an upward direction. Because of the thickness of the top section 236 and curvature of the upper surface 238, the flow path for a fluid moving around the top of the blade 204 is longer than the flow path around the bottom of the blade 204. As the blade 204 is moved through the water, water travelling past the upper surface 238 must therefore travel faster than water moving past the lower surface 242 to travel a greater distance in the same amount of time. As the flow speed increases, the Bernoulli principle dictates that the pressure of the fluid moving past the upper surface 238 decreases. This creates a lift force that urges the blade 204 in an upward direction relative to the top face of the blade 204. Thus, the upper surface 238 can act as a power-producing driving face of the kayak paddle. The feeling of lift generated by the driving face can help a user to feel more stability in the blade. This may be useful, for example when turning the kayak (particularly when leaning, bracing and edging) and when using sculling stroke to move the kayak sideways. In the illustrated embodiments, the net lift force acts in a direction that is perpendicular to the chord line. In some embodiments, however, the net lift force may act in a direction that is angled differently relative to the chord line.

Figure 4:
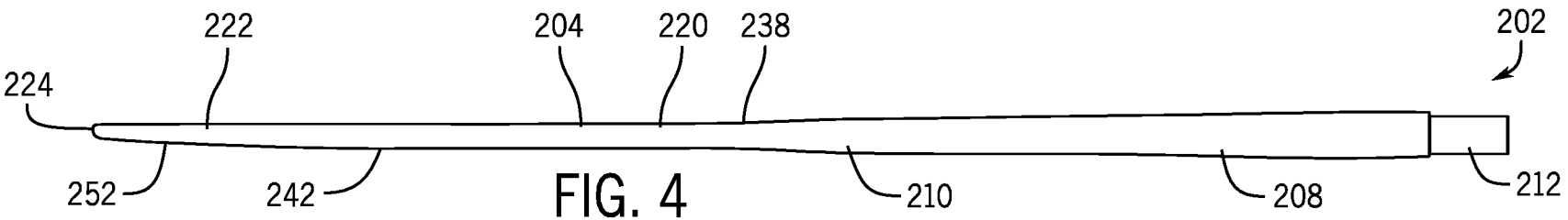
FIG. 4 is a side view of the asymmetric paddle blade of FIG. 2.
Figure 5:
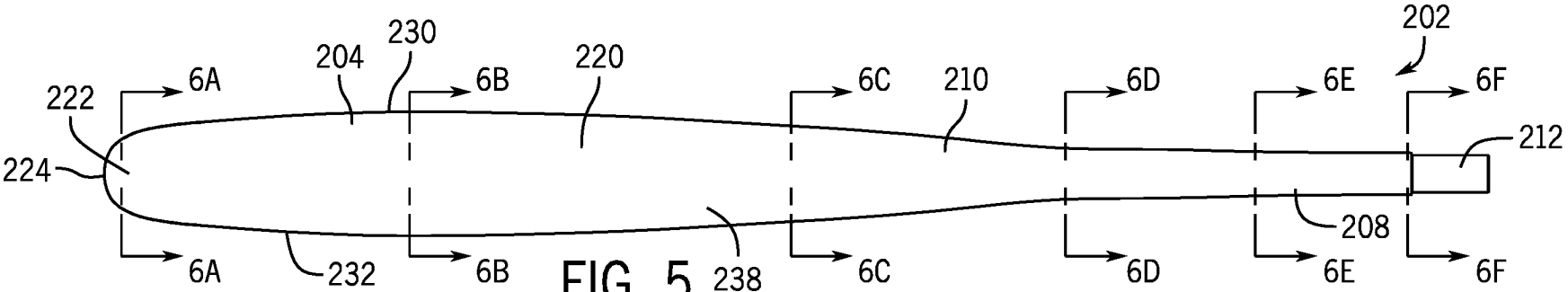
FIG. 5 is a top-down view of the asymmetric paddle blade of FIG. 4.
Figure 6E:
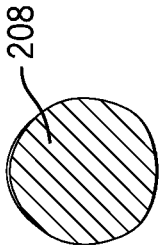
FIGS. 6A-6F are cross-sectional views of the asymmetric paddle blade of FIG. 5.
Figure 6D:
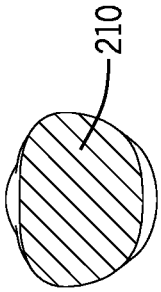
Figure 6F:
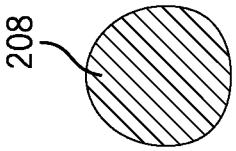
Figure 6C:
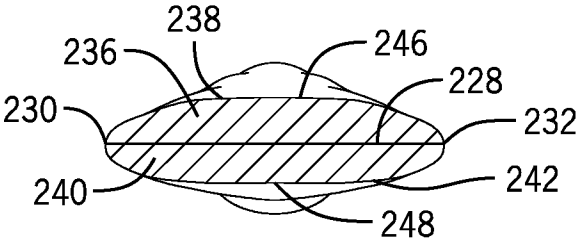
Figure 6B:
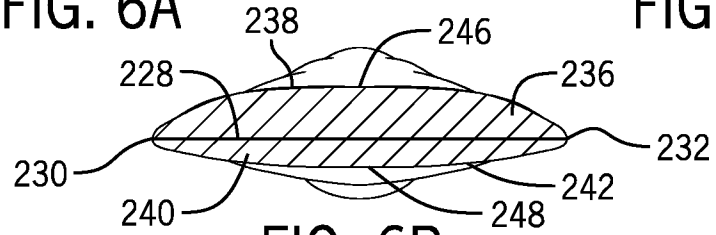
Figure 6A:
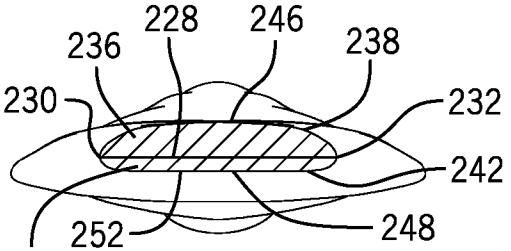

In some embodiments, the cross-sectional profile of the blade body 220 and the tip section 222 can vary along the axial length of the blade 204. For example, the width of the illustrated blade 204 increases along its axial length to a maximum width (as illustrated in FIG. 6B) before narrowing towards the distal end 224. As the width of the blade 204 changes, there is a corresponding change in distance between the leading edge 230 and the trail edge, and therefore the length of the chord line 228. While changes in the width of the blade 204 are relatively gradual along the blade body 220, the lateral edges 230,232 of the blade 204 may curve inward at the tip section 222 to provide the tip section 236 with a rounded top-down profile. As illustrated in FIG. 4, the upper surface 238 can be generally level and does not slope upward or downward along the axial length of the blade 204, providing a relatively flat side profile. The lower surface 242 of the blade 204 is similarly level between the shoulder section 210 and the widest point of the blade body 220, but then begins to slope upward along the axial direction towards the distal end 224. In some embodiments, at least one of the upper surface and the lower surface may have a portion with and upward slope or a downward slope along the length of the blade.

With continued reference to FIGS. 4-6F, the ratio of the top section 236 thickness to the bottom section 240 thickness can increase between the shoulder 210 and the distal end 224 of the blade 204. As the blade 204 widens between the shoulder 210 and the widest point of the blade 204, the lower surface 242 flattens while length of the upper surface 238 increases and the vertical positions of the leading edge 230 and the trailing edge 232 shift downward. This transition moves the chord line 228 downward, increasing the thickness of the upper section 238 of the cross-sectional profile and decreasing the thickness of the lower section 240. As the lower surface 242 slopes upward and the blade 204 narrows between its widest point and the distal end 224, the thicknesses of the upper section 238 and the lower section 242 both decrease. The lower surface 242 continues to flatten and a planar surface 252 develops between the curved lateral edges of the lower surface 242. In some embodiments, the ratio of top section 236 thickness to bottom section 240 thickness can be constant between the widest point of the blade 204 and the tip section 222. In other embodiments, however, the ratio of the top section's thickness to the bottom section's thickness can increase or decrease proximate the tip section.

As the thickness of the top section 236 relative to the bottom section 240 increases towards the distal end 224 of the paddle section 202, the magnitude of the lift force can increase. Similarly, the increased length and curvature of the upper surface 238 and flattening of the lower surface 242 along the length of the blade 204 can result in an increasing lift force towards the distal end 224. This may be useful, for example, in order to further increase stability and enhance kayak paddle strokes.

In some embodiments, an asymmetrical paddle blade may be configured with at least one feature that is different than the illustrated paddle blades. At least one of the upper surface and the lower surface may be configured to be sloped along the length of the blade at an angle that is less than or greater than the angle of the illustrated slopes. Some embodiments of a paddle blade can be configured to have a cross-sectional profile that has at least one of a width, a thickness and curvature that does not change over the length of the blade.

Referring now to FIGS. 7-9F, another embodiment of a paddle section 302 with an asymmetrical paddle blade 304 is illustrated. The cross-sectional profile of the blade 304 is divided into an upper section 336 and a lower section 340 by a chord line 328. Similarly to the embodiments of FIGS. 4-6F, the blade 304 is configured to generate a lift force acting on the blade 304 in an upward direction. For example, the upper section 336 of the cross-sectional profile of the blade 304 can be thicker than the lower section 340, and the upper surface 338 can be longer and exhibits more curvature than the lower surface 342.

Figure 7:
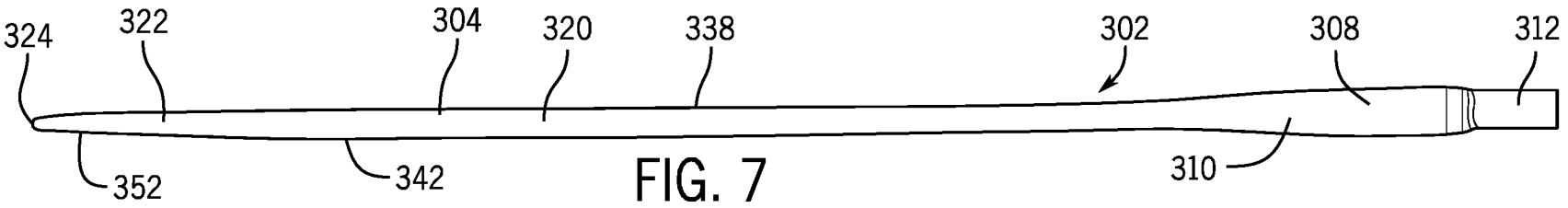
FIG. 7 is a side view of the asymmetric paddle blade of FIG. 3.
Figure 8:
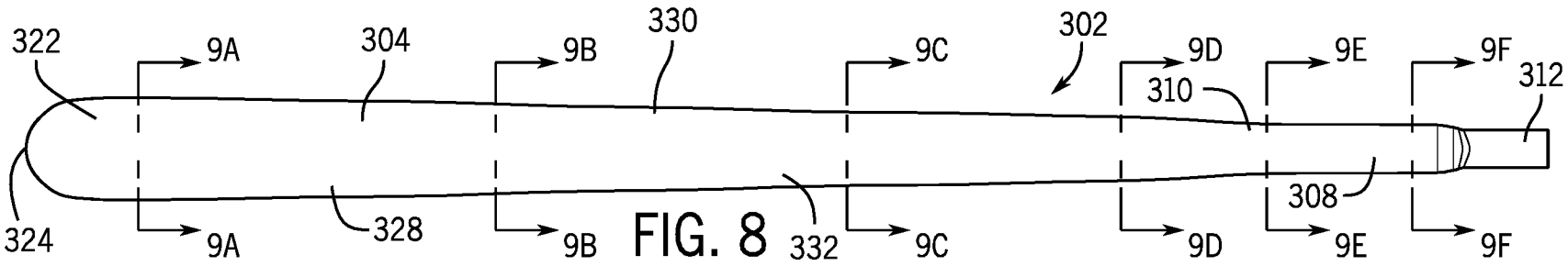
FIG. 8 is a top-down view of the asymmetric paddle blade of FIG. 7.
Figure 9C:
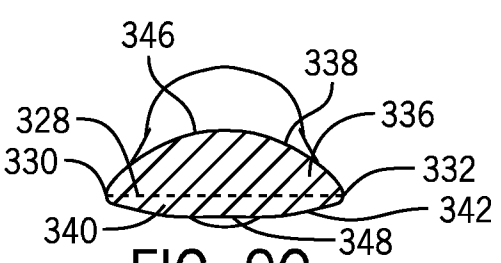
FIGS. 9A-9F are cross-sectional views of the asymmetric paddle blade of FIG. 8.
Figure 9A:
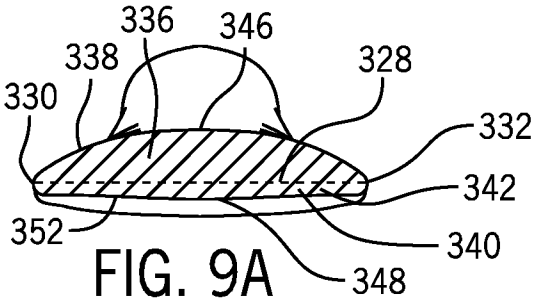
Figure 9B:
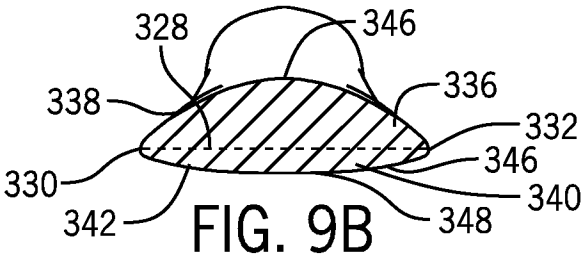
Figure 9E:
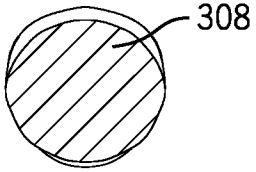
Figure 9D:
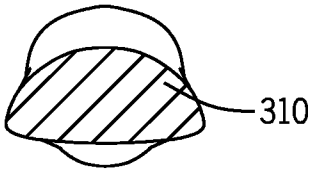
Figure 9F:
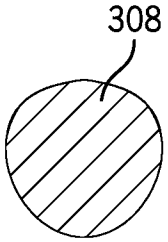

The magnitude of the lift force generated as a result of the shape of blade 304 may vary as the shape of the cross-sectional profile changes along the length of the blade 304 from the shoulder section 310 to the distal end 324. As illustrated in FIG. 8, the width of the cross-sectional profile (measured between the leading edge 330 and the trailing edge 332) increases along the length of the blade body 320 from the shoulder section 310 to a maximum width proximate the tip section 322. As illustrated in FIG. 7, the upper surface 336 gradually slopes downward towards the distal end 324 along the length of the blade 304. The lower surface 342 is also sloped downward along the length of the blade body 320 from the shoulder section 310 towards the tip section 322. However, before the widest point of the blade 304 and proximate the tip section 322, the lower surface 342 begins to slope upward towards the distal end 324 of the blade 304.

In the illustrated embodiments, the slope angle of the downward-sloping portion of the lower surface 342 is slightly larger than the slope angle of the upper surface 336. As the upper and lower surfaces 338, 242 separate, the overall thickness of the blade increases along a portion of the blade body 320. Along this portion of the blade body 320, the thickness of the upper section 336 increases while the thickness of the lower section 340 does not change, increasing the ratio of upper section 336 thickness to lower section 340 thickness. The increasing width of the blade 304 along this length results in an increase in the lengths of the upper surface 338 and the lower surface 342. Because the upper section 336 thickens while the lower section 340 thickness does not change, however, the upper surface 336 retains its curvature while the lower section 342 flattens. In some embodiments, however, the upper surface and the lower surface may be sloped at the same angle and the blade thickness may not increase. Further still, some asymmetrical blades can have a cross-sectional profile that decreases along the full length of the blade.

Once the lower surface 242 begins to slope upward, the overall thickness of the blade 304 decreases along its length towards the distal end 324. Along this portion of the blade 304, the thickness of the lower section 340 decreases at a faster rate than the thickness of the upper section 336 decreases, further increasing the ratio of upper section 336 thickness to lower section 340 thickness. The lower surface 342 continues to flatten and develops a planar surface 352 at the tip section 322. The planar surface 252 is positioned centrally between the curved lateral edges of the lower surface 342 and widens towards the distal end 244. As with the blade 204 of FIGS. 4-6F, the increasing thickness of the upper section 336 relative to the lower section 340 and the flattening of the lower surface 342 along the length of the blade 304 corresponds to an increase in the magnitude of the generated lift force.

Embodiments of a paddle section can be dimensioned base on a variety of different factors. For example the dimensions of a paddle blade may be selected based on at least one of kayak type, kayak size, user skill level, user preferences, or any other factor. Embodiments of a paddle section can be formed with a variety of different materials. For example, a paddle blade may be formed with at least one of wood (such as cedar), fiberglass, carbon fiber, graphite, and any other suitable material.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

I claim:

1. A blade for a kayak paddle with a shaft, the blade comprising:

a blade body extending from the shaft to a blade tip, the blade body having a cross-sectional profile separated at a chord line into a top section with an upper surface and a bottom section with a lower surface;

a shoulder section smoothly transitioning between the shaft and the blade body;

wherein the upper surface and the lower surface are both convex and the lower surface slopes downward along an axial length of the blade and transitions from a downward slope to an upward slope proximate to the blade tip; and wherein the top section is thicker than the bottom section and the upper surface exhibits more curvature than the lower surface, thereby increasing the speed of water moving past the upper surface to generate a lift force when the blade body is moved through water.

2. The blade of claim 1, wherein the lift force acts in a direction perpendicular to the chord line.

3. The blade of claim 1, wherein a ratio of the upper section thickness to the lower section thickness increases along the axial length of the blade between the shoulder section and the blade tip.

4. The blade of claim 3, wherein the length of the upper surface increases along the axial length of the blade.

5. The blade of claim 1, wherein a width of the blade body increases along the axial length of the blade between the shoulder section and the blade tip.

6. The blade of claim 1, wherein the lower surface flattens between the shoulder section and the blade tip.

7. The blade of claim 6, wherein the lower surface includes a planar face positioned between curved edges at opposite lateral sides of the cross-sectional profile.

8. The blade of claim 1, wherein the upper surface slopes downward along the axial length of the blade at a shallower angle than the slope of the lower surface.

9. A kayak paddle comprising:

a shaft extending between opposite axial ends;

two blades, one being attached to each of the axial ends of the shaft, each blade including a cross-sectional profile separated at a chord line into a top section with an upper surface and a bottom section with a lower surface;

wherein the upper surface and the lower surface of the blades are both convex and the lower surfaces of the blades slope downward from the shaft along an axial length of the blade and transition from a downward slope to an upward slope proximate to a blade tip of the blades; and wherein the top section is thicker than the bottom section and the upper surface exhibits more curvature than the lower surface, thereby increasing the speed of water moving past the upper surface to generate a lift force when the blade is moved through water.

10. The kayak paddle of claim 9, further comprising a shoulder section that provides a smooth transition between the shaft and one of the two blades.

11. The kayak paddle of claim 9, wherein the shaft includes a joint positioned between the opposite axial ends, the joint including two corresponding joint sections configured to be selectively disengaged from each other to separate the kayak paddle into a first half and a second half.

12. The kayak paddle of claim 9, wherein a ratio of the upper section thickness to the lower section thickness increases along an axial length of the blades.

13. The kayak paddle of claim 9, wherein a width of the blades increases along an axial length of the blade between the shaft and the blade tip.

14. The kayak paddle of claim 9, wherein the lower surface of the blades flattens between the shaft and the blade tip.

15. The kayak paddle of claim 9, wherein the lower surfaces of the blade flatten between the shaft and the blade tip of each blade, thereby increasing the lift force generated proximate the blade tips.

* * * * *